United States Patent [19]

Tanaka

[11] Patent Number: 4,817,597

[45] Date of Patent: Apr. 4, 1989

[54] SELF-CONTAINED CLOSED-CIRCUIT OXYGEN-GENERATING BREATHING APPARATUS

[75] Inventor: Shunji Tanaka, Hiratsuka, Japan

[73] Assignee: Japan Pionics, Ltd., Tokyo, Japan

[21] Appl. No.: 75,763

[22] Filed: Jul. 20, 1987

[30] Foreign Application Priority Data

Jul. 25, 1986 [JP] Japan ..... 61-113392

[51] Int. Cl.[4] ..... A62B 18/02

[52] U.S. Cl. ..... 128/205.17; 128/205.25

[58] Field of Search ..... 128/205.13, 202.26, 128/204.15, 205.25, 205.17, 205.12

[56] References Cited

U.S. PATENT DOCUMENTS 3,088,810 5/1963 Hay ..... 128/205.28
4,459,981 7/1984 Mascher et al. ..... 128/202.26
4,490,272 12/1984 Malafosse et al. ..... 128/202.26

FOREIGN PATENT DOCUMENTS 51-30873 8/1976 Japan .
55-30504 7/1980 Japan .

*Primary Examiner*—A. M. Chambers
*Attorney, Agent, or Firm*—Parkhurst, Oliff & Berridge

[57] ABSTRACT

A self-contained closed-circuit oxygen-generating breathing appratus is provided with a partition wall disposed in such a manner as to oppose at least the lower portion of the inner surface of a breathing bag. The partition wall partitions the central portion and peripheral portion of the interior of the breathing bag along the inner surface of the breathing bag, and the space or gap between the partition wall and the inner surface of the breathing bag acts as a passage for oxygen-enriched gas discharged from the outlet of a canister of an oxygen-generating agent into the interior of the breathing bag. The oxygen-enriched gas can flow through the passage while kept in good contact with the inner surface of the breathing bag, and thus can be cooled to a temperature suitable for inhalation by the user.

18 Claims, 3 Drawing Sheets

SELF-CONTAINED CLOSED-CIRCUIT OXYGEN-GENERATING BREATHING APPARATUS

BACKGROUND OF THE INVENTION

1. Field of the Invention

The present invention relates to a self-contained closed-circuit oxygen-generating breathing apparatus, and more particularly to a breathing apparatus of this kind which is provided with a breathing bag capable of cooling oxygen-enriched gas to a temperature suitable for inhalation by the user.

2. Description of the Related Art

Hitherto, oxygen masks connected to oxygen cylinders have generally been used as breathing apparatuses in places such as mines, factories and similar sites, and scenes of fires where there is a risk that people may be adversely affected by inhaling air having a low oxygen concentration, poisonous gases, or vapor. However, since these oxygen masks are heavy and difficult to carry, self-contained closed-circuit oxygen-generating breathing apparatuses have recently been developed. Such a breathing apparatus employs as an oxygen-generating agent a substance, such as potassium superoxide ($KO_2$) or sodium peroxide ($Na_2O_2$), which generates oxygen by reacting with the carbon dioxide and moisture contained in exhalation gas.

When the oxygen-generating agent is, for instance, potassium superoxide, it is known that oxygen is generated, in general, by the following chemical reactions:

$$2KO_2+H_2O \rightarrow 2KOH+3/2(O_2)$$

$$2KOH+CO_2 \rightarrow K_2CO_3+H_2O$$

$$2KO_2+CO_2 \rightarrow K_2CO_3+3/2(O_2)$$

All these reactions are exothermic reactions. The amount of heat generated in the reaction between $KO_2$ and water is estimated to be about 6.6 kcal/mol $KO_2$, while that generated in the reaction between $KO_2$ and $CO_2$ is estimated to be about 21.5 kcal/mol $KO_2$.

Various types of self-contained closed-circuit oxygen-generating breathing apparatuses employing an oxygen-generating agent which generates oxygen by reacting with the carbon dioxide and moisture contained in exhalation gas have been developed. A well-known type is the one which mainly comprises a face piece, an exhalation gas tube, a breathing bag, and a canister of an oxygen-generating agent.

Breathing apparatuses of this type are disclosed in, for instance, Japanese Utility Model Publication Nos. 30873/1976, 30504/1980, and Japanese Utility Model Laid-Open No. 2256/1986.

In such a breathing apparatus, exhalation gas exhaled by the user is introduced from the face piece to the oxygen-generating agent canister through the exhalation gas tube, and, in the canister, oxygen is generated by reactions between an oxygen-generating agent and the carbon dioxide and moisture contained in the exhalation gas, and the resulting gas enriched in oxygen passes through the breathing bag and the face piece to be inhaled by the user.

Since the reactions of carbon dioxide and moisture with an oxygen-generating agent generate heat, the temperature of the oxygen-enriched gas discharged from the oxygen-generating agent canister to the breathing bag is raised. Therefore, one of the functions of the breathing bag is to hold the oxygen-enriched gas until it has cooled to a temperature suitable for inhalation by the user.

However, the oxygen-enriched gas discharged from the oxygen-generating agent canister is at a high temperature. In particular, with a self-contained closed-circuit oxygen-generating breathing apparatus which is adapted to contain a large amount of oxygen-generating agent so as to be suitable for a long period of use, the temperature of the gas discharged from the oxygen-generating agent canister could be 100° C. or more near the end of that period. Conventional breathing bags of known breathing apparatuses have not been able to cool the oxygen-enriched gas to a temperature low enough for inhalation by a human being, and the user of such an apparatus often has difficulties in inhalation.

In general, the temperature of a gas which a human being does not find too hot to inhale and which can be inhaled without any pain is about 80° C. when the gas is dry air, but, as the humidity of the gas rises, a human being would find it hot to inhale, even if the temperature of the gas is low. The moisture content of the exhalation gas exhaled by a human being is normally at saturation level. Therefore, a gas containing moisture at this level feels burningly hot when the gas is at a temperature of about 60° C. or more, and reports have stated that a gas containing moisture at this level and having a temperature of about 55° C. sometimes hurts a human being in violent motion. Considering these facts, since the gas to be inhaled has a certain moisture content, it is desired that the temperature of the gas does not exceed 52° C. at most, in order to ensure easy breathing.

In order to solve the above-stated problems, various attempts have been made. For instance, attempts have been made to increase the volume of the breathing bag so as to lengthen the period during which the gas is cooled. However, this has achieved relatively little effect compared to the increase in volume of the bag, and has the disadvantages that the overall apparatus becomes bulky and is inconvenient to put on.

SUMMARY OF THE INVENTION

An object of the present invention is to provide a self-contained closed-circuit oxygen-generating breathing apparatus which has a simple structure and is capable of efficiently cooling oxygen-enriched gas discharged from an oxygen-generating agent canister to a breathing bag to a temperature suitable for inhalation by the user.

Another object of the present invention is to provide a self-contained closed-circuit oxygen-generating breathing apparatus which is light in weight, compact in size, and convenient to carry, and which is capable of ensuring safe and easy breathing for a long period when it is worn by a user.

In order to achieve the above-stated objects, the present inventor has made various studies with a view to accomplishing a self-contained closed-circuit oxygen-generating breathing apparatus in which an oxygen-enriched gas has a low temperature when it is inhaled by the user and which is thus capable of ensuring easy breathing. As a result, the present inventor has found that a very excellent heat radiation effect can be obtained by causing the oxygen-enriched gas to be discharged from the outlet of an oxygen-generating agent canister in such a manner that it runs along the inner surface of a breathing bag, without any need to increase the volume of the breathing bag. The present invention has been accomplished in this way.

The present invention provides an oxygen-generating breathing apparatus having an oxygen-generating agent which generates oxygen by reacting with carbon dioxide and moisture contained in exhalation gas exhalated by a user, comprising a face piece adapted to be placed on a face of the user to receive exhalation gas from the user and supply inhalation gas to the user; an oxygen-generating canister containing the oxygen-generating agent and having an exhalation gas inlet and an oxygen-enriched gas outlet; an exhalation gas passage way connecting the exhalation gas inlet of the canister to the face piece; a breathing bag connecting the oxygen-enriched gas outlet of the canister to the face piece and retaining the oxygen-enriched gas therein for supplying a necessary amount of the oxygen-enriched gas to the face piece as the inhalation gas. The breathing bag according to the present invention is characterized by partition means disposed in the breathing bag for defining a passage for the oxygen-enriched gas discharged from the oxygen-enriched gas outlet of the canister along an inner surface of the breathing bag, so that heat of the oxygen-enriched gas is radiated through the breathing bag while the oxygen-enriched gas passes through the passage.

DETAILED DESCRIPTION OF THE PREFERRED EMBODIMENTS

Figure 1:
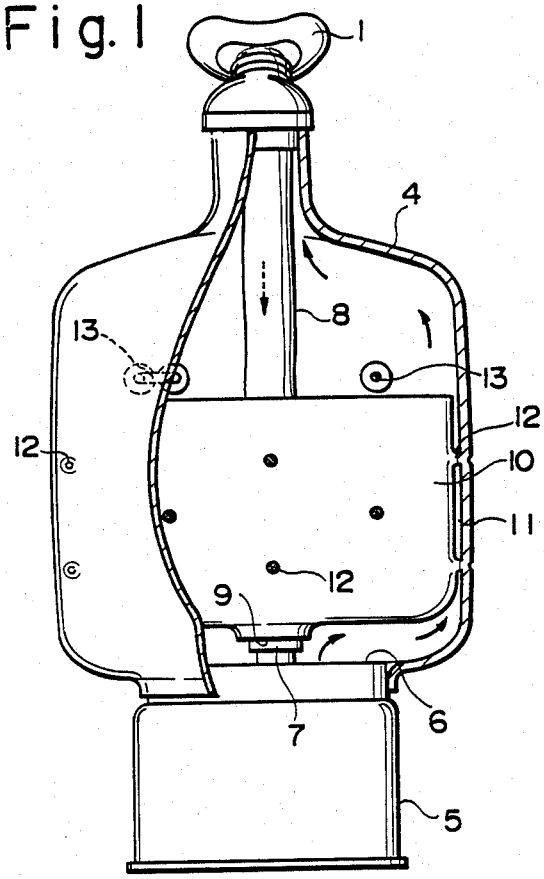
FIG. 1 is a partly-cutaway front view of a self-contained closed-circuit oxygen-generating breathing apparatus in accordance with the present invention.
Figure 2:
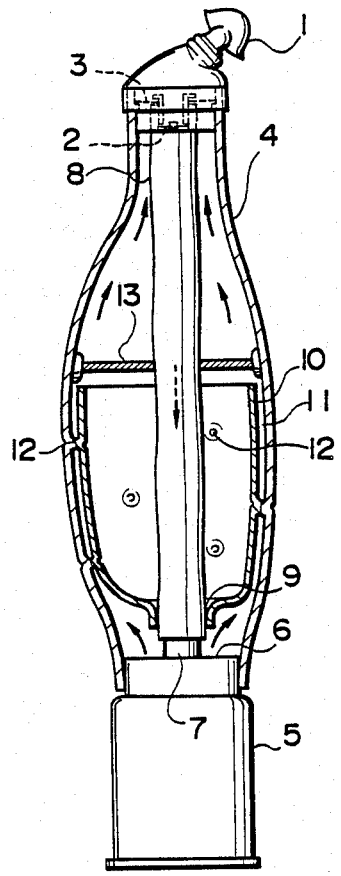
FIG. 2 is a side view of the breathing apparatus in which only a breathing bag and a partition wall of the breathing apparatus are shown in longitudinal section.
Figure 4:
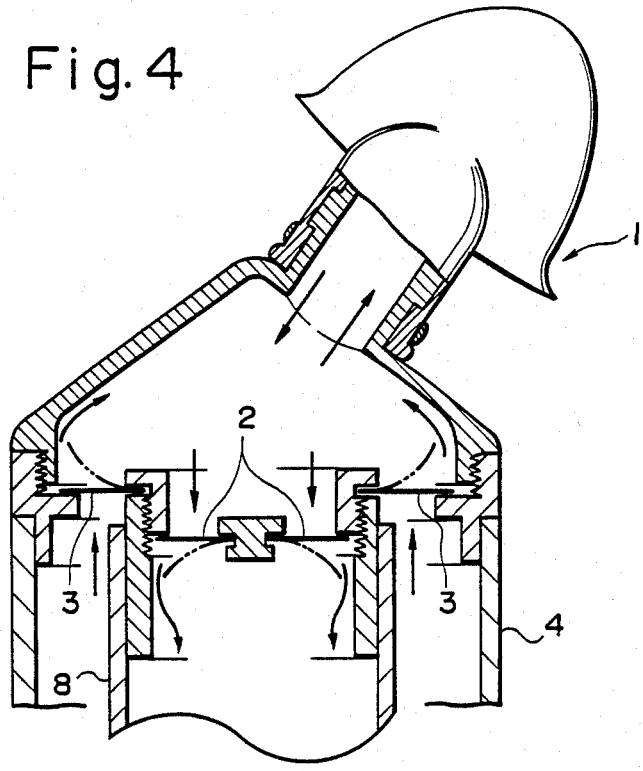
FIG. 4 is an enlarged cross-sectional view of the upper portion of the breathing apparatus showing an exhalation valve and an inhalation valve.
Figure 5:
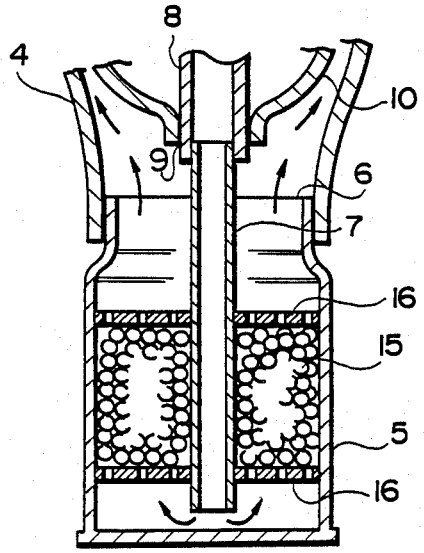
FIG. 5 is an enlarged cross-sectional view of the lower portion of the breathing apparatus showing an oxygen-generating agent.

Referring to FIGS. 1 and 2, a self-contained closed-circuit oxygen-generating breathing apparatus has a face piece which is, for example, a mouth piece 1. As shown in FIG. 4, this mouth piece 1 is provided with an exhalation valve 2 and an inhalation valve 3, both of which are well-known in the art. The upper edge of a breathing bag 4, which has an approximately elliptic-cylindrical shape, is connected to the mouth piece 1, while the lower edge of the breathing bag 4 is connected to an outlet 6 for oxygen-enriched gas formed in the upper surface of an oxygen-generating agent canister 5 which is approximately elliptic-cylindrically shaped. As shown in FIG. 5. the oxygen-generating agent canister 5 contains an oxygen-generating agent 15 which generates oxygen by reacting with the carbon dioxide and moisture contained in exhalation gas. The upper surface of the canister 5 has, at the substantially central location, an inlet 7 for exhalation gas, and this inlet 7 for exhalation gas of the oxygen-generating agent canister 5 and the exhalation valve 2 of the mouth piece 1 are connected within the breathing bag 4 by a exhalation gas tube 8. The inlet 7 extends through the oxygen-generating agent 15 disposed between upper and lower filters 16 and 16, so that exhalation gas, which has passed through the inlet 7, goes upwardly through the lower filter 16 to contact the oxygen-generating agent 15 and the oxygen-enriched gas is discharged through the upper filter 16 upwardly from the outlet 6.

The breathing apparatus is provided with a partition wall 10 which is elliptic-cylindrically shaped with an outer circumference slightly smaller than the inner circumference of the breathing bag 4 and which is in the form of a bag which is preferably open at the top and has a hole 9 in the bottom. This partition wall 10 is concentrically disposed within the breathing bag 4 in such a manner as to oppose to the substantially lower half portion of the inner surface of the breathing bag 4. The exhalation gas tube 8 passes through the hole 9 of the partition wall 10, and the edge around the hole 9 is secured to the corresponding portion of the outer surface of the exhalation gas tube 8 in an air-tight manner so that oxygen-enriched gas discharged from the outlet 6 of the oxygen-generating agent canister 5 is prevented from entering the bag-shaped partition wall 10 directly. The space or gap between the inner surface of the breathing bag 4 and the outer surface of the partition wall 10 acts as a passage 11 for oxygen-enriched gas discharged from the outlet 6 of the oxygen-generating agent canister 5 into the breathing bag 4. In order to prevent the space or gap from becoming too large, the breathing bag 4 and the partition wall 10 are partially bonded together at spot bonds 12. In addition, in order to prevent the space between the front and rear surfaces of the breathing bag 4 from expanding, these surfaces are partially connected by a pair of fixing strings 13, 13.

The self-contained closed-circuit oxygen-generating breathing apparatus having the structure described above is used with the mouth piece 1 held in the user's mouth.

Exhalation gas exhaled by the user is introduced from the mouth piece 1 into the exhalation gas tube 8 through the exhalation valve 2, and enters the oxygen-generating agent canister 5 from the inlet 7. In the canister 5, the exhalation gas comes into contact with the oxygen-generating agent 15, and reactions between the oxygen-generating agent and the carbon dioxide and moisture contained in the exhalation gas generate oxygen at a high temperature. The resulting gas enriched with oxygen reaches the outlet 6 of the canister 5.

The oxygen-enriched gas is then discharged into the interior of the breathing bag 4 through the passage 11 formed between the inner surface of the breathing bag 4 and the outer surface of the partition wall 10. While the oxygen-enriched gas follows through the passage 11, since the gas is kept in good contact with the inner surface of the breathing bag 4, it is able to radiate heat to the atmosphere efficiently and thus be cooled, and then is held within the breathing bag 4. The oxygen-enriched gas which has thus been cooled and held within the bag 4 is led through the inhalation valve 3 to the mouth piece 1 and is again inhaled by the user, thereby enabling easy breathing.

In place of the mouth piece 1 described above, another form of the face piece, such as a half mask which covers the mouth and nose of the user or a full facepiece which covers the entire face, may be used.

A material which provides a high degree of air-tightness, and which has both a high degree of flexibility and a good heat-radiation effect is normally used as the material for the breathing bag 4. Some examples of such materials are various kinds of non-woven fabric or woven fabric coated with rubber or resin, plastic film, and composite films of these materials. The volume of the breathing bag 4 is normally 3 to 12 l. Although the shape of the breathing bag 4 is not specifically limited, shapes having larger surface areas relative to their volumes are preferred. Some examples of such shapes are elliptic cylinders and flattened prisms. In addition, in order to prevent the breathing bag 4 from expanding and being deformed by excessive gas in the system, the front and rear surfaces of the bag should preferably be partially connected by members such as fixing strings 13. It is also possible to add an automatic air-release valve to the breathing bag 4.

The material for the exhalation gas tube 8 should preferably be a flexible material, and materials similar to those which can be used for the breathing bag as well as rubber are suitable examples.

The shape of the partition wall 10 provided within the breathing bag is not specifically limited so long as it can form a passage along which the oxygen-enriched gas discharged from the oxygen-generating agent canister 5 flows while it is efficiently kept in contact with the inner surface of the breathing bag. However, the partition wall 10 is normally formed into an elliptic cylinder, a flattened prism or a cylinder to conform with the shape of the breathing bag, and is made into a bag with an opening at its top. The partition wall 10 should partition the interior of the breathing bag 4 into a peripheral portion and a central portion at least at the lower portion of the inner surface of the bag 4. In practice, the height of the partition wall 10 is normally at least one-fifth the height of the breathing bag, preferably at least one-third that of the breathing bag. The width of the space or gap between the inner surface of the breathing bag and the partition wall is between about 2 and 50 mm, preferably between about 3 and 30 mm, which ensures that the space or gap can act as a passage that enables the oxygen-enriched gas to flow while it is efficiently kept in contact with the inner surface of the breathing bag. If the width of the space of the gap is excessively large, the cooling efficiency is reduced. In order to prevent this problem, the breathing bag and the partition wall should preferably be partially bonded at spot bonds 12 or along linear bonds.

A rigid material or a flexible material is used as the material for the partition wall 10. Some examples of rigid materials are metals and rigid plastics, while examples of flexible materials are the same flexible materials as those that can be used for the breathing bag and the exhalation gas tube. Since it is advantageous if the breathing bag could be folded and kept in a case so that the overall volume of the breathing apparatus is not too large when it is not in use, a flexible material should preferably be selected from among these materials for the partition wall as well. When the breathing bag is of the above-mentioned type, if a coil spring of a suitable shape is provided within the breathing bag, this will enable automatic expansion of the breathing bag as it is taken out of the case before use, thereby reserving the air required for initial breathing.

The oxygen-generating agent canister 5 is formed of a material such as a metal or rigid plastic, into a shape such as a right cylindrer, an elliptic-cylindrer, or a prism. Normally, an inlet for gas and an outlet for gas which surrounds the inlet are formed in the upper surface of the canister 5. An oxygen-generating agent, such as potassium superoxide ($KO_2$) or sodium peroxide ($Na_2O_2$), which generates oxygen by reacting with the carbon dioxide and moisture contained in exhalation gas is contained in the canister, either directly or in the form of a cartridge.

EXAMPLES

In order to clarify the effect of the self-contained closed-circuit oxygen-generating breathing apparatus of the present invention, tests were conducted and the results were found to be as given below.

A self-contained closed-circuit oxygen-generating breathing apparatus as shown in FIGS. 1 and 2 was prepared as the breathing apparatus of the present invention. This apparatus had a breathing bag, a partition wall disposed within the breathing bag, and an oxygen-generating agent canister. The breathing bag was formed of cloth coated with rubber and had a volume of about 9 l, a width as viewed from the front of about 400 mm, and a height of side surfaces of about 300 mm. The partition wall had a height of about 160 mm and was formed of a cloth coated with rubber into a bag shape. The breathing bag and the partition wall were partially bonded at spot bonds so that the space or gap therebetween during the breathing of the user was between 3 and 20 mm. The oxygen-generating agent canister contained 400 g of an oxygen-generating agent mainly consisting of potassium superoxide ($KO_2$).

For the purpose of comparison, a comparative self-contained closed-circuit oxygen-generating breathing apparatus was also tested. This comparative breathing apparatus had exactly the same structure as that of the breathing apparatus of the present invention, except that it had no partition wall.

The tests were conducted in the following manner. The breathing apparatus of the present invention and the comparative breathing apparatus were each connected to a recirculation-type breathing test machine, air having a temperature of about 35° C. and a relative humidity of 95% and containing 4% of carbon dioxide was supplied to the apparatus at a room temperature of 20° C. and at a rate of 30 l/min, and the temperature of the inhalation gas was measured.

Figure 3:
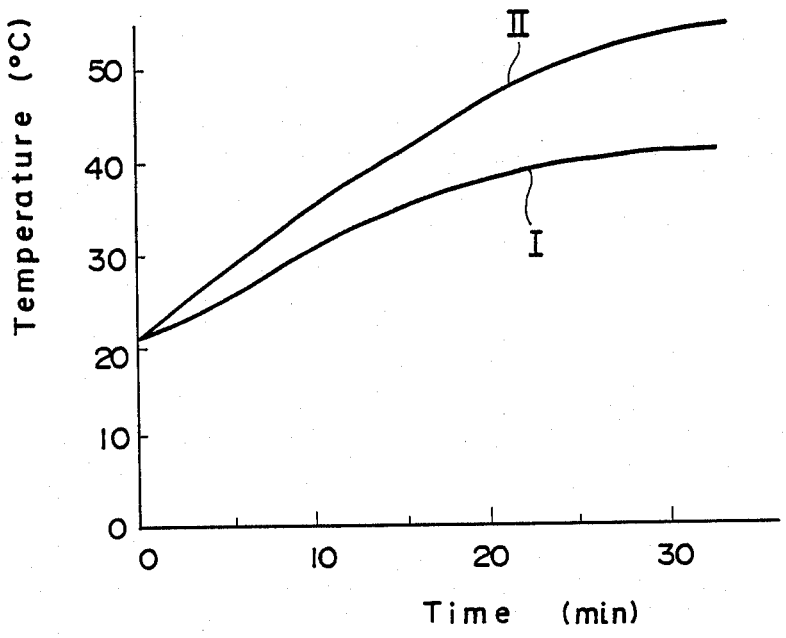
FIG. 3 is a graph of the temperature of inhalation gas in the breathing apparatus in accordance with the present invention and the temperature of inhalation gas in a conventional breathing apparatus of the same type.

The results are shown in FIG. 3 by curves indicating the relationships between temperature and time.

Curve I indicates the relationship in the breathing apparatus of the present invention in which the partition wall is provided, while curve II indicates the relationship in the comparative breathing apparatus in which no partition wall is provided. At the beginning of the tests, the temperatures of inhalation gases in these breathing apparatuses were both in the vicinity of 20° C. because of the effects of air remaining in the breathing bags at the start. However, as time passed, the temperatures of both inhalation gases gradually increased, and the difference between the curves I and II became larger. After fifteen minutes, the temperature rising along the curve I was about 35° C., while the temperature rising along the curve II was about 42° C. After thirty minutes, the temperatures were 40° C. and 53° C., respectively.

As will be clear from these test results, by virtue of the provision of the partition wall, the self-contained closed-circuit oxygen-generating breathing apparatus in accordance with the present invention exhibits an excellent heat radiating effect, thus efficiently restraining a rise in temperature of inhalation gas.

The self-contained closed-circuit oxygen-generating breathing apparatus in accordance with the present invention, therefore, has a wide applicability such as to evacuation instruments from fire scenes, instruments for mining purposes or other safety instruments for various industrial sites.

I claim:

1. An oxygen-generating breathing apparatus having an oxygen-generating agent which generates oxygen by reacting with carbon dioxide and moisture contained in exhalation gas exhalated by a user, comprising:

a face piece adapted to be placed on a face of the user to receive exhalation gas from the user and supply inhalation gas to the user;

an oxygen-generating canister containing the oxygen-generating agent and having an exhalation gas inlet and an oxygen-enriched gas outlet;

an exhalation gas passageway connecting the exhalation gas inlet of said canister to said face piece;

a breathing bag connecting the oxygen-enriched gas outlet of said canister to said face piece and retaining the oxygen-enriched gas therein for supplying a necessary amount of the oxygen-enriched gas to said face piece as the inhalation gas; and partition means disposed in said breathing bag for defining a longitudinally elongated passage for the oxygen-enriched gas discharged from the oxygen-enriched gas outlet of said canister, said elongated passage extending along the length of said breathing bag along an inner surface of said breathing bag, so that heat of the oxygen-enriched gas is radiated through said breathing bag while the oxygen-enriched gas passes through said passage.

2. An oxygen-generating breathing apparatus as set forth in claim 1, wherein said face piece is associated with valve means for allowing the exhalation gas from the user to be introduced to said exhalation gas passageway and for allowing the oxygen-enriched gas from said breathing bag to be supplied to the user.

3. An oxygen-generating breathing apparatus as set forth in claim 1, wherein said exhalation gas passageway is defined by a tube disposed within said breathing bag.

4. An oxygen-generating breathing apparatus as set forth in claim 1, wherein said partition means extends in a closely spaced relation to the inner surface of said breathing bag at least at a portion of said breathing bag adjacent to the oxygen-enriched gas outlet of said canister so as to define said passage for the oxygen-enriched gas.

5. An oxygen-generating breathing apparatus as set forth in claim 4, wherein a space of said passage between said partition means and the inner surface of said breathing bag is within a range of 2 to 50 mm.

6. An oxygen-generating breathing apparatus as set forth in claim 4, wherein said partition means comprises a peripheral wall which is opposed to the inner peripheral surface of said breathing bag in a spaced relation and said partition means has a hollow open top.

7. An oxygen-generating breathing apparatus as set forth in claim 6, wherein said exhalation gas passage way extends through said partition means and a bottom edge of said peripheral wall of said partition means is secured to a tube for defining said exhalation gas passageway, whereby the oxygen-enriched gas discharged from said oxygen-enriched gas outlet is directed to said passage for the oxygen-enriched gas.

8. An oxygen-generating breathing apparatus as set forth in claim 4, wherein said partition means is made of a flexible material and partially connected to the inner surface of said breathing bag.

9. An oxygen-generating breathing apparatus as set forth in claim 4, wherein a length of extension of said partition means is at least one-fifth a length of extension of said breathing bag.

10. An oxygen-generating breathing apparatus as set forth in claim 1, wherein said breathing bag is shaped into a cylinder, a elliptic cylinder or a flattened prism.

11. An oxygen-generating breathing apparatus as set forth in claim 10, wherein said breathing bag comprises means for restricting expansion of its peripheral wall.

12. An oxygen-generating breathing apparatus as set forth in claim 1, wherein said oxygen-generating agent is potassium superoxide or sodium peroxide.

13. An oxygen-generating breathing apparatus as set forth in claim 1, wherein said partition means comprises a cylindrical wall concentrically disposed within and spaced from said breathing bag, so that said elongated passage is defined between said cylindrical wall and the inner peripheral surface of said breathing bag.

14. An oxygen-generating breathing apparatus as set forth in claim 13, wherein said cylindrical wall is provided with a bottom portion having a substantially center hole, through which said exhalation gas passageway is extended, whereby the gas discharged from the oxygen-enriched gas outlet of said canister is introduced via an outer surface of said bottom portion to said elongated passage.

15. An oxygen-generating breathing apparatus as set forth in claim 1, further including means for limiting expansion of said breathing bag.

16. An oxygen-generating breathing apparatus as set forth in claim 1, further including means bonding selected portions of said partition means to said breathing bag inner surface along the length of said breathing bag.

17. An oxygen-generating breathing apparatus having an oxygen-generating agent which generate oxygen by reacting with carbon dioxide in moisture contained in exhalation gas exhaled by a user comprising:

a face piece for receiving exhaled gas from the user and supplying oxygen-enriched gas to the user;

an oxygen-generating canister containing the oxygen-generating agent and having an exhalation gas inlet and an oxygen-enriched gas outlet;

an exhalation gas passageway connecting the exhalation gas inlet of said canister to said face piece;

a breathing bag connecting the oxygen-enriched gas outlet of said canister to said face piece for retaining the oxygen-enriched gas therein and for supplying a necessary amount of the oxygen-enriched gas to said face piece as the inhalation gas;

partition means disposed in said breathing bag for defining a longitudinally elongated passage for the oxygen-enriched gas discharged from the oxygen-enriched gas outlet of said canister, said elongated passage extending along the length of said breathing bag and along an inner surface of said breathing bag so that the heat of the oxygen-enriched gas is conducted through said breathing bag while the oxygen-enriched gas passes through said passage;

said partition means comprising a bag member having a first end secured about the exhalation gas passageway and a second open end, said bag member having an outer wall adjacent to and spaced from the inner surface of said breathing bag thereby defining said elongated passage; and means to attach at least a portion of said bag member outer wall to said breathing bag inner surface at a plurality of locations to limit a width of said elongated passage between said bag member and said breathing bag, and means limiting expansion of said breathing bag.

18. The oxygen-generating breathing apparatus of claim 17, wherein said means to attach said partition means to said breathing bag inner surface includes a plurality of spot bonds, and said means to limit expansion of said breathing bag includes at least one fixing string.

* * * * *